US008828895B2

(12) United States Patent
Foss et al.

(10) Patent No.: US 8,828,895 B2
(45) Date of Patent: Sep. 9, 2014

(54) WEBS OF BI-COMPONENT AND MONO-COMPONENT CO-PLA FIBERS

(75) Inventors: Stephen W. Foss, Naples, FL (US); Jean-Marie Turra, Greer, SC (US)

(73) Assignee: Nonwoven Network LLC, Naples, FL (US)

( * ) Notice: Subject to any disclaimer, the term of this patent is extended or adjusted under 35 U.S.C. 154(b) by 16 days.

(21) Appl. No.: 12/971,505

(22) Filed: Dec. 17, 2010

(65) Prior Publication Data

US 2012/0051672 A1 Mar. 1, 2012

Related U.S. Application Data

(60) Provisional application No. 61/376,845, filed on Aug. 25, 2010.

(51) Int. Cl.

| | |
|---|---|
| ***D04H 3/00*** | (2012.01) |
| ***D04H 13/00*** | (2006.01) |
| ***D04H 1/56*** | (2006.01) |
| ***D04H 3/10*** | (2012.01) |
| ***D04H 1/435*** | (2012.01) |
| ***D04H 1/541*** | (2012.01) |
| ***D04H 1/54*** | (2012.01) |
| ***D04H 1/55*** | (2012.01) |

(52) U.S. Cl.

CPC ..... *D04H 1/435* (2013.01); *D04H 1/541* (2013.01); *D04H 1/54* (2013.01); *D04H 1/55* (2013.10)

USPC ..... 442/414; 442/327; 442/400; 442/408

(58) Field of Classification Search

USPC ..... 442/327, 333, 334, 400, 408, 414

See application file for complete search history.

(56) References Cited

U.S. PATENT DOCUMENTS

| | | | | |
|---|---|---|---|---|
| 5,620,724 | A * | 4/1997 | Adler | 99/317 |
| 2002/0143116 | A1 * | 10/2002 | Noda et al. | 525/411 |
| 2003/0113411 | A1 * | 6/2003 | Rose et al. | 426/77 |
| 2004/0013831 | A1 * | 1/2004 | Whittaker et al. | 428/35.2 |
| 2005/0120884 | A1 * | 6/2005 | Kerner | 99/275 |
| 2005/0136155 | A1 * | 6/2005 | Jordan et al. | 426/77 |
| 2005/0203258 | A1 * | 9/2005 | Kimura et al. | 525/450 |
| 2008/0057309 | A1 * | 3/2008 | Liu et al. | 428/375 |
| 2009/0041903 | A1 | 2/2009 | Moon | |
| 2009/0278279 | A1 | 11/2009 | Uradnisheck | |
| 2010/0330236 | A1 | 12/2010 | Miyahara et al. | |

FOREIGN PATENT DOCUMENTS

| | | | |
|---|---|---|---|
| EP | 1 553 224 | A1 | 7/2005 |
| JP | 2001-063757 | A | 3/2001 |
| TW | 200948615 | | 12/2009 |
| WO | WO 02/48443 | A1 | 6/2002 |

OTHER PUBLICATIONS

The Complete Textile Glossary, published by Celanese Acetate, LLC (2001), definition for Wet Laid Nonwoven.*

International Search Report issued in connection with co-pending International Appln. No. PCT/US2011/049085 on Mar. 8, 2012 (4 pages).

(Continued)

*Primary Examiner* — Jeremy R Pierce

(74) *Attorney, Agent, or Firm* — McCarter & English, LLP

(57) ABSTRACT

Web material for production of tea bags and the like made of a nonwoven network of PLA fibers in mono-component and/or bi-component forms.

22 Claims, 8 Drawing Sheets

(56) References Cited

OTHER PUBLICATIONS

Written Opinion issued in connection with co-pending International Appln. No. PCT/US2011/049085 on Mar. 8, 2012 (6 pages).

Search Report issued by the Patent Office of the People's Republic of China in connection with co-pending Chinese Patent Appln. No. 201180040569.5 on Jun. 12, 2014 (3 pages).

Extended Search Report mailed Jun. 10, 2014 issued by the European Patent Office in connection with co-pending European Patent Application No. 11 82 0637.4 (11 pages).

* cited by examiner

Bi-Component Fiber

WEBS OF BI-COMPONENT AND MONO-COMPONENT CO-PLA FIBERS

The present application claims priority from U.S. application 61/376,845 filed Aug. 25, 2010. The present invention relates to heat-sealable liquid infusion web materials and end products made from such webs such as tea bags or pouches, coffee bags or pouches, herbal sachets, bags for particulate liquid cleansing agents (with and without binder agents). The present invention provides a nonwoven web for such uses, containing 100% or nearly so Polylactic Acid (PLA) fibers designed to be essentially 100% biodegradable, essentially 100% recyclable, and maintain a minimum distortion of pore size during heating in hot liquids.

BACKGROUND OF THE INVENTION

Field of the Invention

There is a need for an infusion substrate, particularly for tea and coffee, which provides rapid infusion of hot water into the tea or coffee particles, while being strong enough to keep the particles within a bag or pouch made up in substantial part or wholly of such substrate. There is also a need for heat-sealable pouch for tobacco and tobacco products (i.e. snuff and chewing tobacco).

Further, it is highly desirable that the substrate media be 100% bio-degradable and not contain any inert or non-biodegradable components.

Further, it is highly desirable that the media, including all of the production scrap, be recyclable into itself.

Significant development of Polylactic Acid (PLA) fiber was conducted by Cargill Inc. to make fibers from natural raw materials and resultant process and products are described in U.S. Pat. No. 6,506,873.

Kimberly Clark mentions PLA in its U.S. Pat. No. 7,700,500, "Durable hydrophilic treatment for biodegradable polymer substrate."

U.S. Pat. No. 6,510,949 by Grauer et al teaches that hydrophilic substances may be impregnated into filter paper to improve the water-wet ability and water absorption.

Tea bags and coffee pouches traditionally have been made of paper and teabags suffer from slow infusion times and tend to float on the liquid surface.

A new tea bag fabric from Japan has been made using a nylon knitted mesh, which provides rapid infusion, but requires a non-traditional sealing method, are expensive and are not biodegradable.

Attempts have been made to produce a spun melt nonwoven from PLA, but it suffers from poor sealability and performance in automated packing machines.

SUMMARY OF THE INVENTION

The present invention provides a highly porous media of web form, divisible and fabricatable into end product components (e.g. bags, pouches) or portions of the same that is produced from PLA, alone or with Co-PLA fibers, using a thermo bonded nonwoven manufacturing method. The media exhibits high efficiency for infusion of hot water into the coffee or tea (or other liquid as more broadly indicated above). The fibers self bond at many cross over points through web heating and/or pressure applications in initial web production and/or subsequent steps.

The web material of the invention is produced in a continual process that provides for controllable machine processing direction and cross machine direction properties that enhance the performance of the media. By controlling the % of the lower melt Co-PLA in an intimate blend of PLA and Co-PLA fibers, the thermo bonding strength can be controlled during web manufacture by fiber orientation, temperature setting, and time of exposure to heat. During bag or pouch manufacture, the strength of the sealing bond can be controlled by temperature, dwell time, and knife pressure.

PLA and Co-PLA have specific gravity of 1.25, i.e. greater than water, which causes the bag or pouch to sink and to be submerged and be totally engulfed in the hot water. Further, PLA is naturally hydrophilic, without special treatment, which allows the water to flow quickly into the tea or coffee.

The Co-PLA can be chosen with a melt point from 125° C. to 160° C. by varying the isomer content of the polymer. Thus it is possible to address the sealing requirements of various automated packaging machines.

Not only is the media made from a renewable raw material, but the scrap fiber, nonwoven trim scrap, and the bag making scrap can be remelted, extruded into a pellet, and blended into the extrusion operation to make more fiber. It is from 100% renewable source and it is 100% recyclable. During the fiber manufacturing process, any "waste" fiber may be re-extruded into pellets and put back into the fiber process. During the nonwoven web production process, any startup or trim "waste" may be re-extruded into pellets and put back into the fiber process. During the infusion package manufacturing process, any trim, start-up, or other web "waste" may be re-extruded and put back into the fiber manufacture process.

Unlike PET, nylon, and most papers, which contain latexes and synthetic fillers, the media of the present invention is 100% compostable. After hydrolysis at 98% humidity and 60C or higher, PLA is readily consumed by microbes and its component atoms are converted for possible re-use in growing more corn, beets, rice or etc. for future conversion to PLA.

The invention was produced in three weights: 16, 18 and 20 gsm (grams per square meter, but could be produced in a lighter or heavier weight).

DETAILED DESCRIPTION OF PREFERRED EMBODIMENTS

A preferred embodiment of the invention was made, and is explained as follows, including all or most of its fibers in bi-component form and its production of mono-component PLA fiber made from Fiber Innovation Technologies (Type T811) was blended with core/sheath bi-component (BiCo) fibers with PLA in the Core and Co-PLA in the sheath. The core/sheath area ratio was 50/50%. Fibers were produced with a ratio between 80/20% and 20/80%. Other fiber producers such as Palmetto Synthetics and Foss Manufacturing Company can make these fibers. PLA fibers typically are made using lactic acid as the starting material for polymer manufacture. The lactic acid conies from fermenting various sources of natural sugars. These sugars can come from annually renewable agricultural crops such as corn or sugar beets. The polymer must be completely dried prior to extrusion to avoid hydrolysis. PLA is an aliphatic polyester and the helical nature of the PLA molecule makes it easier to crystallize than PET. The PLA can be extruded into a fiber using standard PET fiber equipment.

Figure 1:
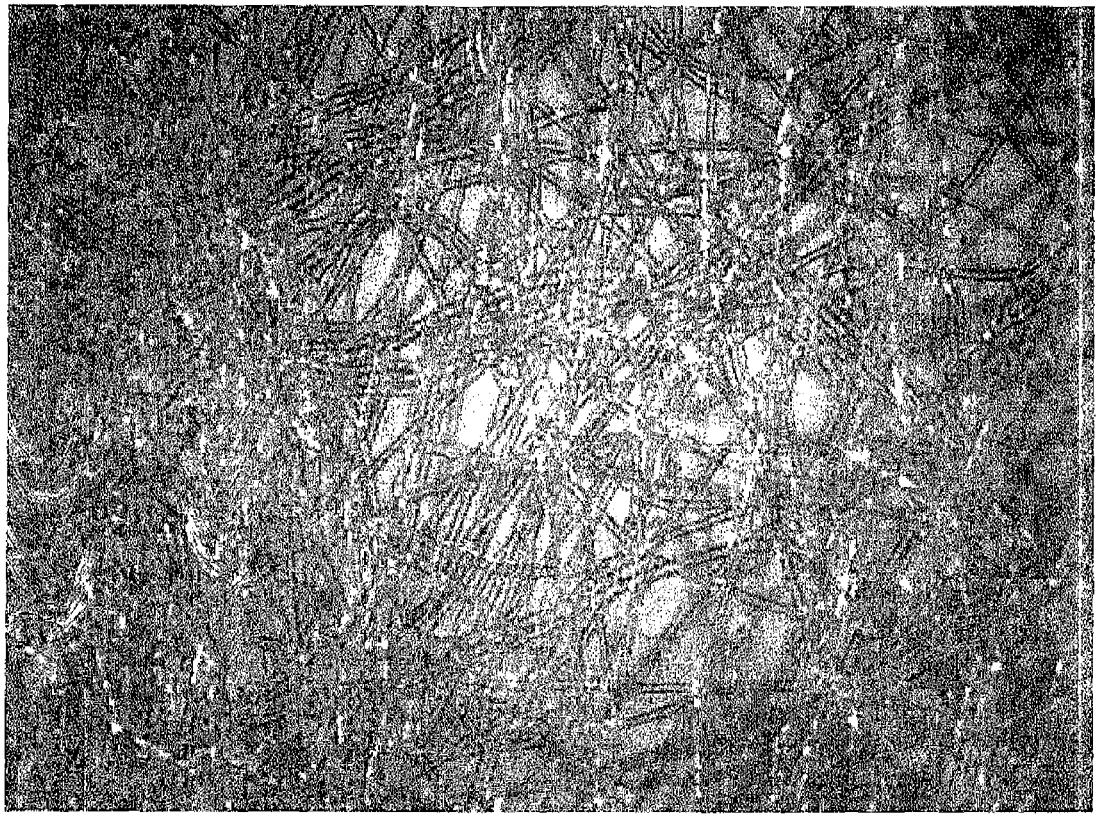
FIG. 1 is photomicroscope slide (1) at 40× magnification power showing an 18 gsm web with 30% (by weight) co-PLA/70% PLA which exhibited excellent strength and superb sealing characteristics. It should perform equally well at lighter weights from 12 to 20 gram per square meter (gsm)
Figure 2:
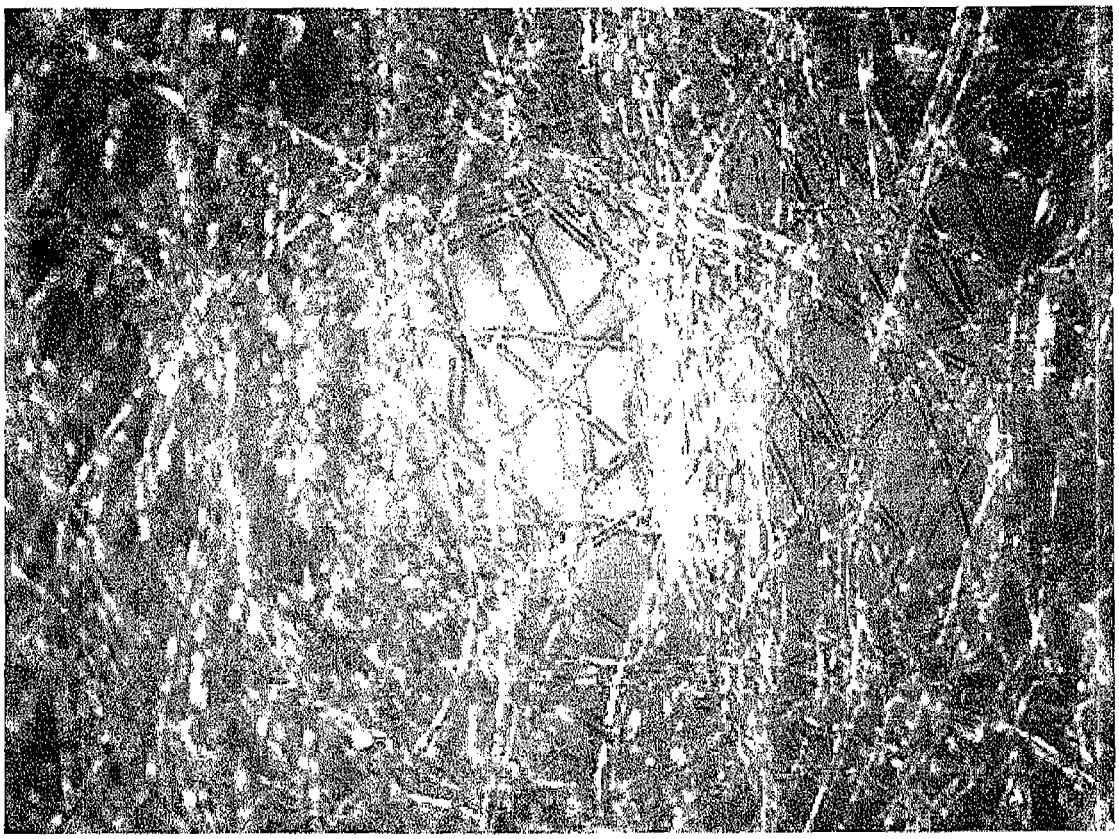
FIG. 2 is photomicroscope slide (2) showing an 16 gsm web with 10% co-PLA/90% PLA blend, which exhibited adequate strength but did not have enough low melt fiber to seal effectively.
Figure 3:
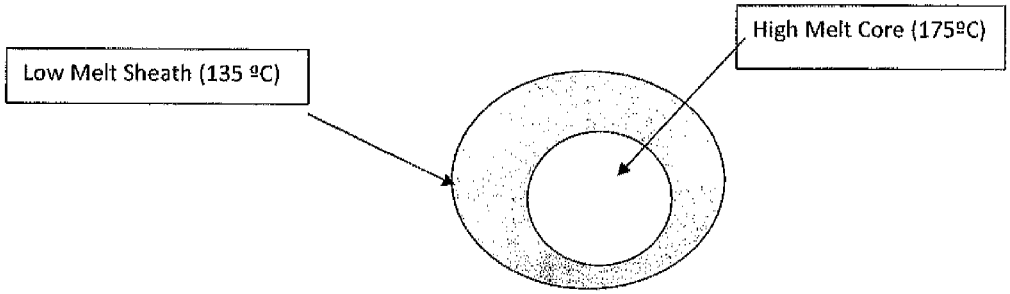
FIG. 3 is a drawing of a bi-component fiber with a high melt core (PLA@175° CM) and a low-melt sheath (Co-PLA@135° C.).
Figure 4:
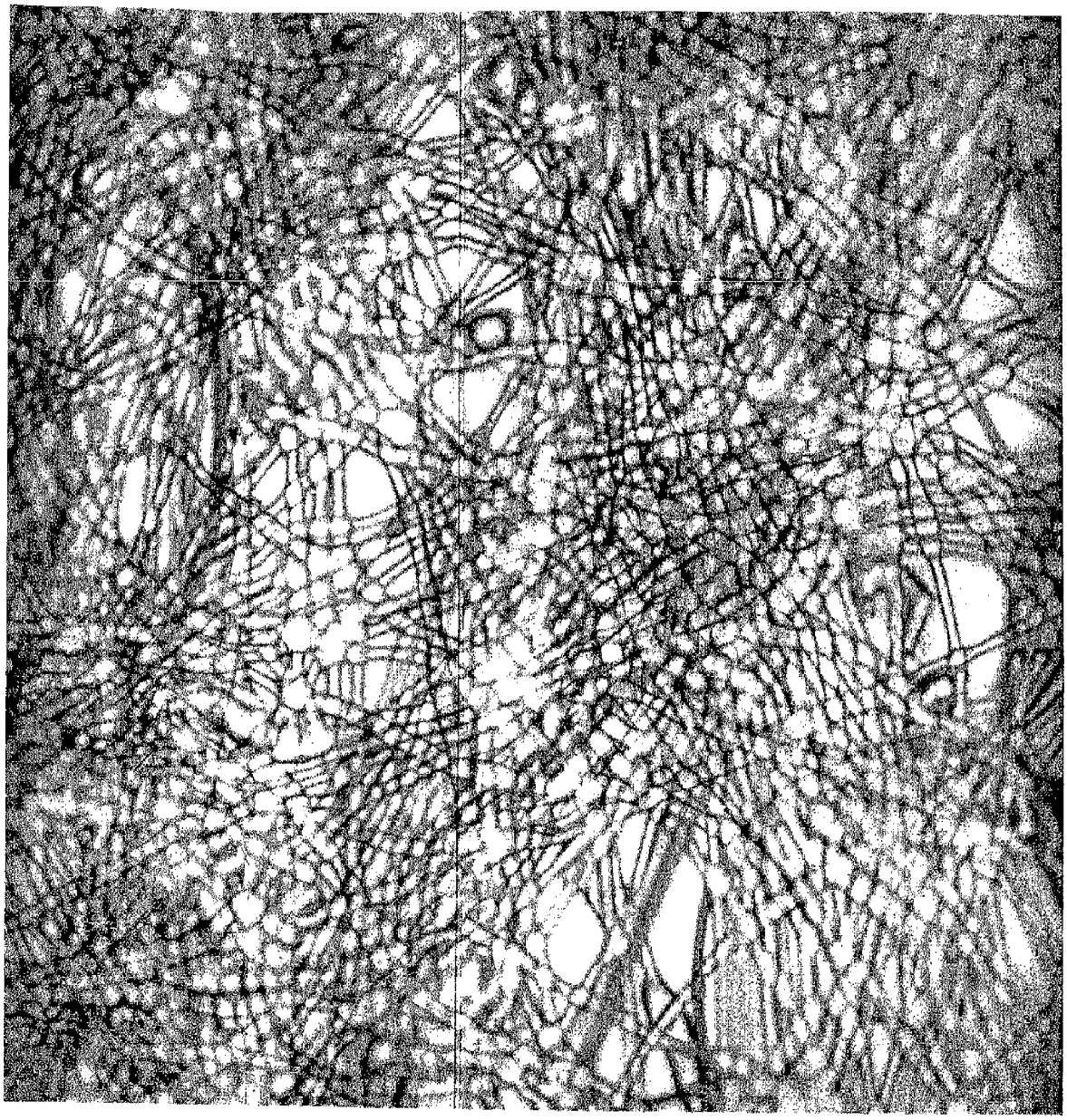
FIG. 4 is a Microscope slide of 85/15% blend at 18 gsm—40 power.
Figure 5:
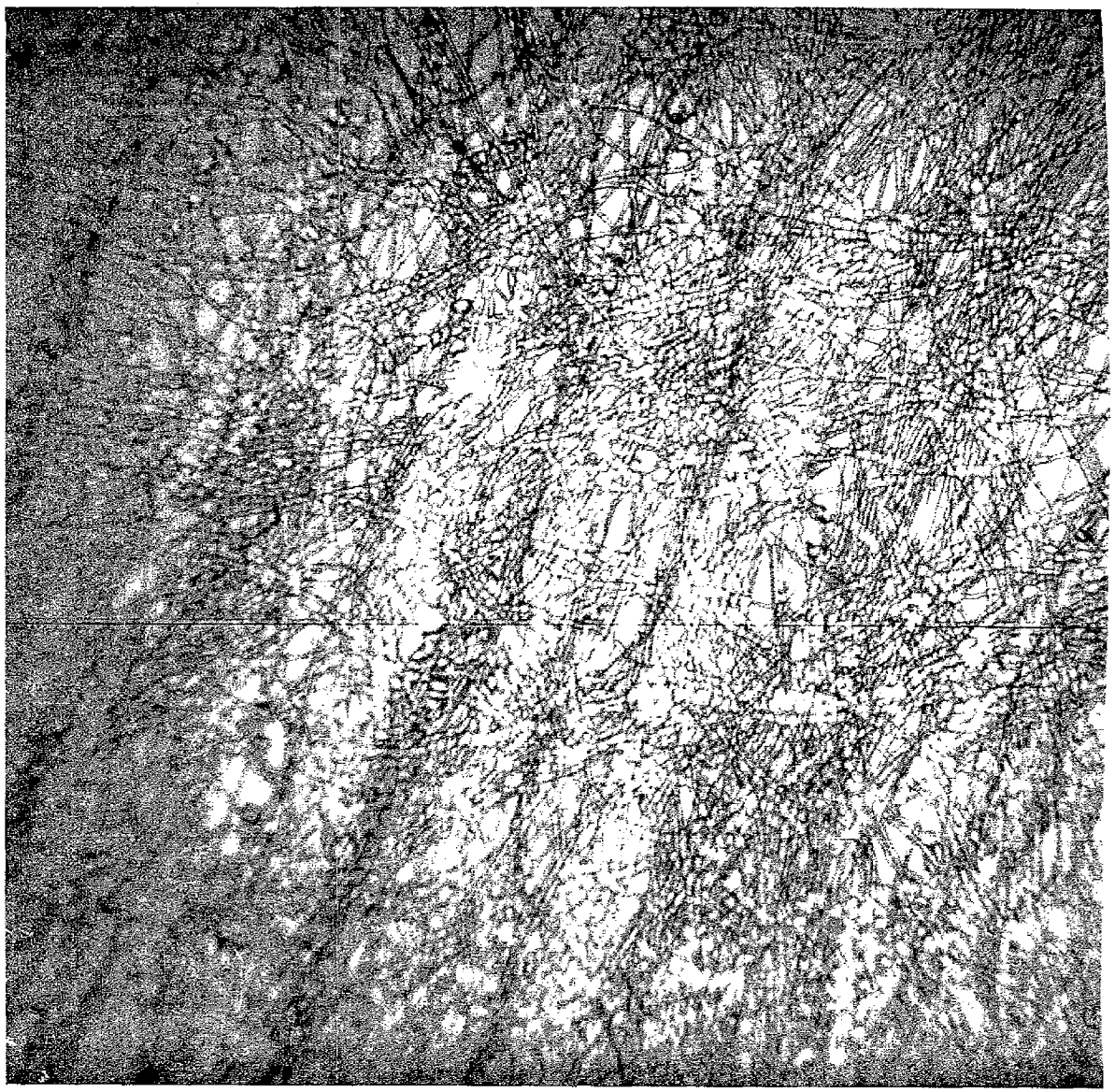
FIG. 5 is a Microscope slide of 80/20% blend at 18 gsm—40 power.
Figure 6:
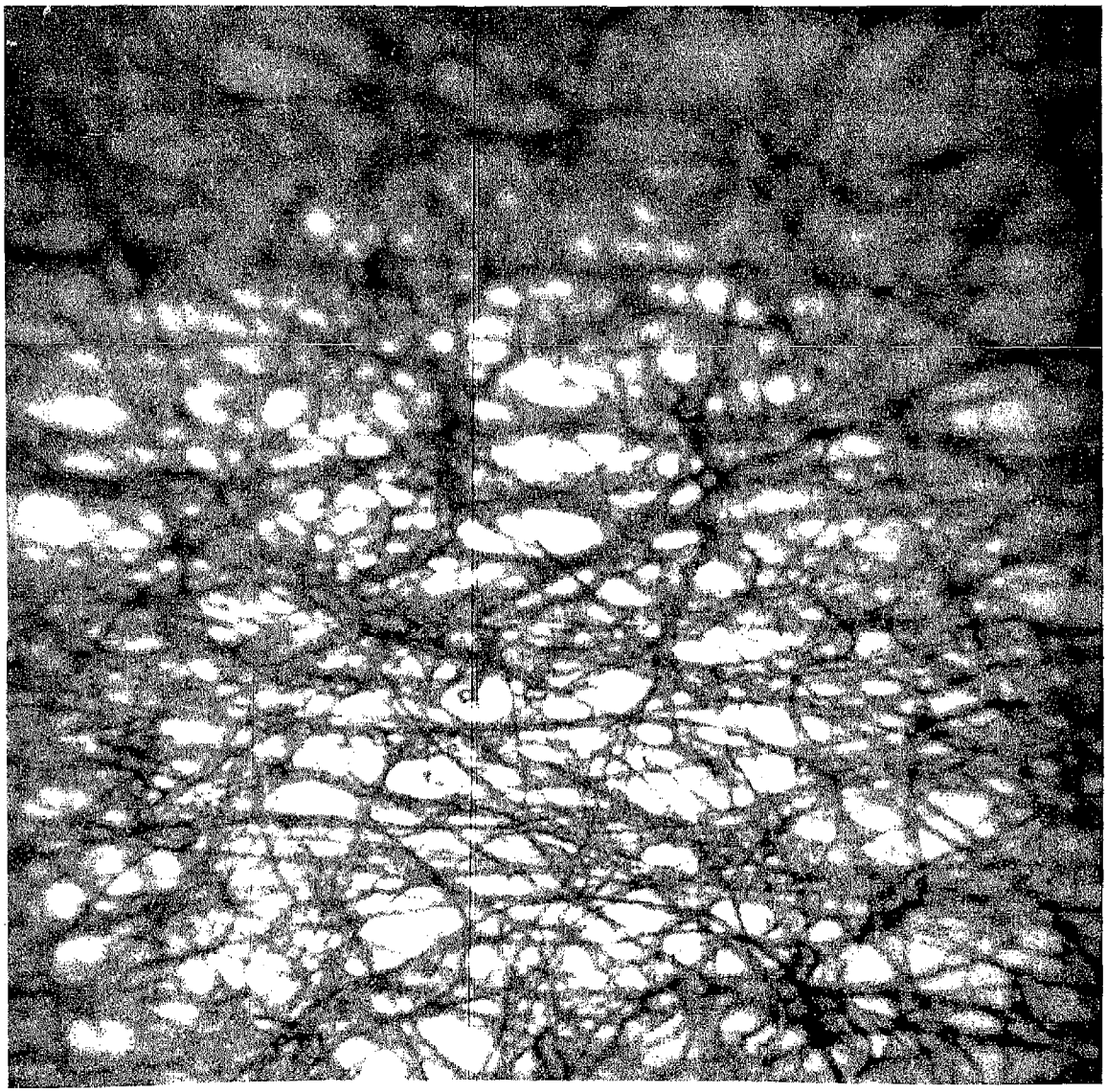
FIG. 6 is a microscope slide of 80/20% blend at 18 gsm—100 power.
Figure 7:
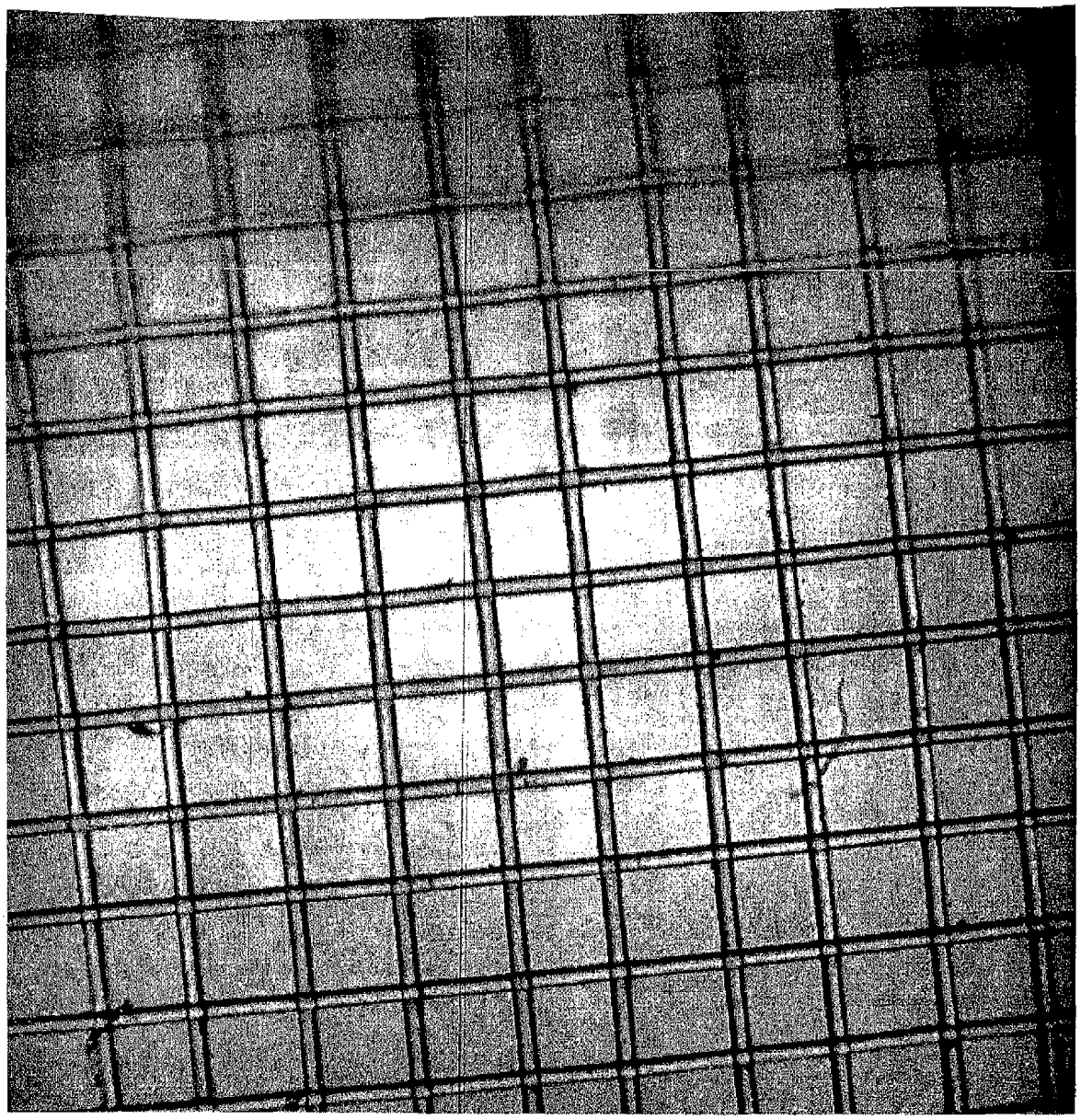
FIG. 7 is a microscope slide of standard paper.
Figure 8:
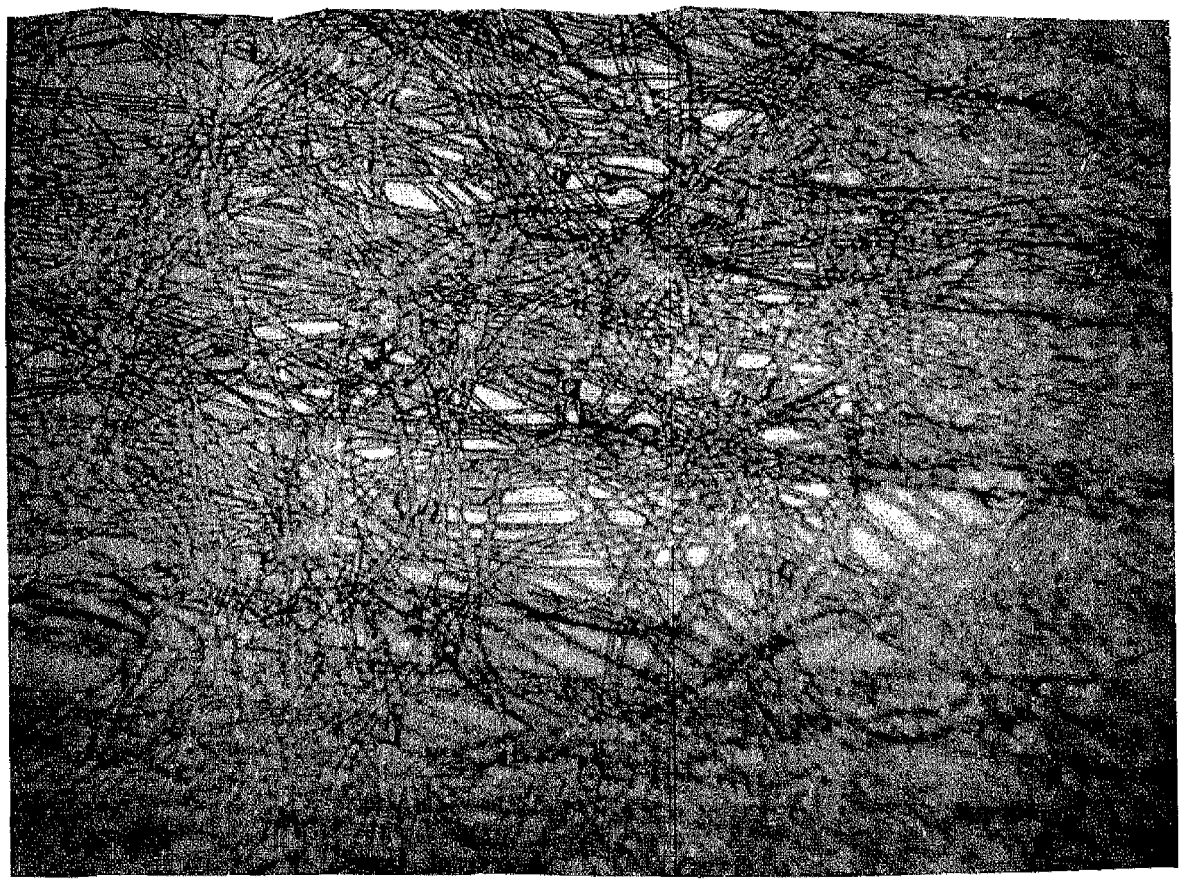
FIG. 8 is a microscope slide of a Japanese made nylon fabric.

In the case of the mono-component PLA fiber, the high temperature variant with a melt temperature of 175[deg.] C. is extruded into a fiber. The initial fiber is then drawn 3.5 times its length to get to the required 1.5 denier. It is then crimped and heat set to 140[deg.] C. to improve the crystallinity and stabilize the crimp. It is then cut to 1.5" (38 mm). In the case of the Bi-CO fiber, a melt spinning line using the co-extrusion spinerettes made by Hills Inc, of Melbourne Fla. was used. The spinerettes of the line produced a fiber similar to FIG. 3. The higher melting (175[deg.] C.) PLA is in the core, while the lower melting Co-PLA (135[deg.] C.) is in the sheath. Generally, the low melt Co-PLA is fully amorphous, which makes it easier to melt and flow around the crystalline mono-component PLA fibers. The core PLA fiber remains and combines with (bonds to) the mono-PLA fiber at many cross-over points in the web for strength. A web comprising PLA fibers has two different melting points, 145C-175C and 105C-165C, respectively. The PLA fibers have a melting (softening) point of 145C to 175C and the Co-PLA fiber, mono-component is CoPLA with a melt temperature from 105C to 165C.

The blend percentages were varied from 90% PLA/10% BiCo to 60% PLA/40% BiCo. The 70/30% produced the best fabric for strength and sealability. It is also possible to make a blend of crystalline PLA (175° C. melt point) and a mono-component fiber made from 100% Co-PLA (melt point between 135° and 165° C.) Blending is performed by weighing out the desired percentages of PLA and BiCo fibers either manually or with automated weigh feeders. The two fibers are layered on top of each other and fed into an opener which has feed rolls, feeding the fibers into a cylinder with teeth that pulls the clumps into individual fibers. The fibers are then blown into a blending bin to create a homogeneous mixture by first layering the fibers uniformly in the bin and then cross-cutting the layers with a spiked apron which feeds the fibers to a carding system.

The carding system consists of two feeding hoppers. The first acts as a reserve holding bin to ensure continuous supply. The second feeding hopper has a continuous scale with a load cell that provides a set weight feed to the card. The card is a series of interacting cylinders covered with toothed wire that tears and combs the fibers into a parallel web.

The fabric weights were varied from 12 to 20 gsm, with the 18 gsm chosen for testing. It is believed that the 16 gsm (not run) will provide the best characteristics.

The production line was a Asselin-Thibeau line with 3 carding machines, each 2.3 meters wide. The web was run in a straight line and fed into a calendar with 460 mm diameter rolls heat with thermal oil at a temperature of 130° C. to 152° C. Line speeds were 40 meters per minute at a finished width of 2.0 meters.

If a parallel web is desired, the fibers coming straight out of the carding system are combined with the other two cards and thermo-bonded. This generally results in a Machine Direction (MD)/Cross Machine Direction (CMD) strength ratio of 4:1. If a more balanced strength ratio is desired then a "randomizer" roll system may be added to one or more cards. The result can be MD/CMD strength ratio up to 1.5:1.

By controlling the carding system and fiber orientation, the fibers can be aligned in a manner to control the apertures or openings in the web to enhance rapid infusion of the hot water.

The rolls were slit to a width of 156 mm (6.14") for the Tea Bag machine.

The tea bag machine was a model ASK020 made by Miflex Masz. Two rolls were placed on the machine and centered on the mold. The correct amount of tea was deposited and the top and bottom sheet sealed automatically at a temperature of 135C with a dwell time between 0.5 and 0.8 seconds.

The present invention cuts easily on standard tea/coffee packaging machines with a simple knife device and creates minimal amount of lint or loose fibers.

The web maintains its pore size during the infusion with hot liquids because the fibers do not swell. This enhances to flow of water into the tea or coffee, reducing the brewing time.

Because the web fibers do not swell, the risk of gas pressure build up is eliminated and thus the risk of bag breakage and particle dispersion is eliminated.

Using boiling water, the infusion time is reduced to one (1) minute

When pressed, the infusion liquid completely leaves the container (bag or pouch), leaving a silky, translucent surface.

Recycling of PLA is very easy, a depend on the place in the process. During fiber manufacture, all of the fibers from both spinning and drawing can be re-extruded to pellets by densifying the fiber scrap using an "Erema" or "Mechanic Moderne" recycling line (There are many others that will also work). The equipment will densify the fibers and partially melt them to pre-dry to drive off any moisture. The dense particles are forced into a vented extruded to remove all of the moisture. The PLA is then fully melted and extruded and filtered to form pure amorphous pellets. The pellets can then be blended with virgin pellets to make new fiber. During the Thermo-Bond process, scrap fiber, edge trim, and defective fabric can be baled and shipped back to the recycling system described above. During the Tea-Bag process, the trimming scrap and "skeleton" scrap, especially from making round pouches, can be baled and reprocessed as described above. Finally, the tea bags can be composted after use and the PLA will turn back into sugars which can be used to make more PLA.

The present invention may also be used as pouches for: lemonade, herbal sachets, soap powder, chemicals and chlorine for pools and spas, decontaminating liquids, coloring of liquids, dehumidifying chemicals, carriers for phase-change materials for heating or cooling, tobacco pouches, and all materials that can be placed in a heat/ultra sound activated sealable container.

A further preferred embodiment comprises a tea bag material and end product made in whole or in part of a mono-component fiber with self bonding property to similar fibers or other to produce effective web material and effective end product.

A preferred mono-component is co-PLA with a melt temperature of 135° C. Such a fiber was produced in a 1.3 denier× 38 mm fiber. This produced a fiber which is 100% binder as opposed to a bi-component fiber, generally consisting of 50/50 PLA/Co-PLA. The Mono-component fiber was blended with standard PLA fiber in a ratio of 85% PLA/15% CoPLA. The blend was processed on a carded web line at 18 and 20 gsm. The result was a significantly stronger web than that produced with the bi-component fiber. The web was clearer and less opaque than the one with the Bi-co fiber. This is a very desirable attribute.

In a second trial, the mono-component Co-PLA fiber was blended with the type 811 PLA fibers in a ratio of 80/20%. The web was produced in a weight of 18 and 20 gsm. The strength increased and the fabric was less opaque or more translucent. Rolls of both of the types were then slit to appropriate widths and processed on tea bag machines. A further advantage was that the PLA/CoPLA blend absorbed less water that the standard paper. While both the PLA and Standard paper weighed 18 gsm dry, the PLA reached 90 gsm when fully saturated with water, while the standard paper reached 200 gsm.

A first trial was on a Fuso machine replacing an expensive nylon fabric. The tea bags formed well and the seams were stronger than those made with the nylon fabric. The 18 gsm with the 80/20 blend provided the best results.

To improve strength, uniformity, and fiber distribution, one of the carding machines (out of 5) was modified by placing a randomizing unit on the doffer or take off rolls. On a standard card machine, the fiber orientation is generally 5:1 in the machine versus cross machine direction and can be optimized to 3.5:1. With the randomizing rolls, the orientation is about 1.5:1 for the card with the randomizer. The resultant composite web had an orientation of between 2:1 and 3:1. This was a significant improvement. The resultant webs showed no degradation of strength during wet conditions that standard tea bag paper exhibits.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. A nonwoven web for use in producing beverage infusion pouches and bags, said web consisting of:

a plurality of mono-component mono-constituent Polylactic Acid (PLA) fibers forming said web by dry thermo-bonding that is free from plasticizers and use of other special surface treatments, wherein said web provides for biodegradability after usage and recyclability of waste materials during each step of a manufacturing process of said web;

the mono-component mono-constituent Polylactic Acid (PLA) fibers having an amorphous portion and a crystalline portion; the amorphous portion for facilitating ease of melt and flow around the crystalline portion so that the fibers self bond through at least one of web heating and pressure applications;

wherein said mono-component mono-constituent Polylactic Acid (PLA) fibers form pore sizes of the web that are maintained if infused with hot liquids to enhance flow.

2. A web as in claim 1 wherein the web fibers have a fiber length of between about 20 mm to 90 mm.

3. A web as in claim 1 wherein the web fibers have a length of 38 mm.

4. A web as in claim 1 wherein the web fibers are from between about 0.6 denier to 6.0 denier.

5. A web as in claim 1 wherein the web fibers are 3.0 denier.

6. A web as in claim 1 wherein the web fibers are 1.5 denier.

7. A web as in claim 1 wherein the web fibers are 1.2 denier.

8. A web as in claim 1 having a dry basis weight from between about 8 to 50 grams per square meter.

9. A web as in claim 1 wherein the PLA mono-component mono-constituent fibers have two different melting points for a crystalline portion and an amorphous portion that is 145-175° C. and 105-165° C. respectively.

10. A web as in claim 1 wherein the fibers are 100% of PLA fibers that melt at a temperature of between about 135° to 175° C.

11. A web as in claim 1 where a proportion of fibers are the mono-component mono-constituent PLA fibers are between 0.8 to 26 Denier.

12. A web as in claim 11 wherein the web fibers consist of the mono-component mono-constituent fibers have two different melting points that is a melting point of 145° to 175° C. and from 105° to 165° C. having a lower melting temperature than the melting temperature of other mono-component mono-constituent fibers.

13. A web as in claim 1 wherein the mono-component mono-constituent fibers further include a thermally active component that is 5% to 50% by weight, wherein percentages are based on weight of the web.

14. A web as in claim 1 usable as material for bags or pouches for: Lemonade, herbal sachets, coffee, tea, hot chocolate, soap powder, chemicals and chlorine for pools and spas, decontaminating liquids, coloring of liquids, dehumidifying chemicals, carriers for phase-change materials for heating or cooling, tobacco pouches, and all materials that can be placed in at least one of a heat and ultra sound activated sealable container.

15. A bag or pouch as formed essentially entirely from the web of claim 1.

16. A bag or pouch using a web as in claim 1, but made using randomizing rolls so that the fibers in the web are randomized.

17. A web as in claim 1 wherein the fibers are at-least two mono-component mono-constituent fibers of PLA having different melting points for forming the web such that a first fiber melts at a higher temperature than a second fiber.

18. A web as in claim 1 wherein the web is a beverage infusion package for providing biodegradability after usage and recyclability of waste materials during each step of the manufacturing process from polymer to finished web.

19. A web as in claim 18 usable in bags or pouches for materials selected from the group consisting of: lemonade, herbal sachets, coffee, tea, hot chocolate, soap powder, chemicals and chlorine for pools and spas, decontaminating liquids, coloring of liquids, dehumidifying chemicals, carriers for phase-change materials for heating or cooling, tobacco pouches, and wherein said bags or pouches are sealable by heat or ultra sound.

20. A web as in claim 19 where a string, attached to each of the bags having a paper tab, is made of the mono-component mono-constituent Polylactic Acid (PLA) fibers.

21. A web as in claim 18 wherein the crystallinity of the mono-component mono-constituent Polylactic Acid (PLA) fibers are controlled by drawing and then crimping and heat setting.

22. A web as in claim 18 further including a dry basis weight from between about 8 to 50 grams per square meter.

* * * * *